United States Patent [19]

Kakuta et al.

[11] 4,346,157

[45] Aug. 24, 1982

[54] COMPLEX TYPE ELECTROPHOTOGRAPHIC PLATE

[75] Inventors: Atsushi Kakuta, Hitachiota; Shigeo Suzuki, Hitachi; Yasuki Mori, Hitachi; Hirosada Morishita, Hitachi, all of Japan

[73] Assignee: Hitachi, Ltd., Tokyo, Japan

[21] Appl. No.: 232,829

[22] Filed: Feb. 9, 1981

Related U.S. Application Data

[63] Continuation-in-part of Ser. No. 70,822, Aug. 29, 1979, abandoned.

[30] Foreign Application Priority Data

Sep. 4, 1978 [JP] Japan ..... 53/107466
Nov. 8, 1978 [JP] Japan ..... 53/136697

[51] Int. Cl.[3] ..... G03G 5/09

[52] U.S. Cl. ..... 430/58; 430/59; 430/900; 252/500

[58] Field of Search ..... 430/58, 59, 900; 252/500

[56] References Cited

U.S. PATENT DOCUMENTS 4,245,021 1/1981 Kazami et al. ..... 430/58
4,278,746 7/1981 Goto et al. ..... 430/59

*Primary Examiner*—John D. Welsh
*Attorney, Agent, or Firm*—Craig & Antonelli

[57] ABSTRACT

A complex type electrophotographic plate comprises a conductive support; a first layer, adhered to the support, of a charge generating material, said first layer having a thickness of 0.1 to 5 μm; and a second layer, superposed on the first layer, of a homogeneous mixture of a charge transport material and an insulating, resinous binder therefor, said second layer having a thickness of 5 to 100 μm and being substantially transparent to light of a wave length of 4200 to 8000 Å; wherein said charge transport material is at least one member selected from the class consisting of nonionic compounds represented by the general formula: X—(CH=CH)$_n$Ar where X is a heterocyclic group selected from the group consisting of and Y is O or S, R is a lower alkyl group; the hetero ring may be substituted; n is an integer of 0, 1 or 2; and Ar is an aryl or substituted aryl group.

The electrophotographic plate has a high light sensitivity and can be used in more than $10^3$ repetitions without fatigue.

18 Claims, 4 Drawing Figures

COMPLEX TYPE ELECTROPHOTOGRAPHIC PLATE

This is a continuation in part application of Ser. No. 70,822 filed Aug. 29, 1979, now abandoned.

This invention relates to a complex type electrophotographic plate, and particularly to a complex type electrophotographic plate with an effective charge transport material having a distinguished light sensitivity and a distinguished durability to repetitions or reusability without fatigue.

According to the prior art, a complex type electrophotographic plate consists of an electroconductive substrate and a layer comprised of a charge generating material and a charge transport material provided on the electroconductive substrate, the layer being comprised of a homogeneous single layer containing said two materials, or being in a multi-layer structure consisting of a charge generating layer and a charge transport layer. The charge transport material is transparent and non-absorptive to the light in a specific range of wavelength used in the electrophotography, and has an essential function to accept and transport the electrons or holes injected from the charge generating material. The photoconductive characteristic of the charge generating material can be improved by use of such charge transport material, and also the charge generating material can be physically protected, thereby forming a strong photosensitive plate.

As to the charge transport material having such functions, many compounds have been proposed especially in the complex type electrophotographic plate of multilayer structure. That is, a provision of a coating layer containing a polyvinylcarbazole or its derivative as a main component, is disclosed in U.S. Pat. Nos. 3,879,200 and 3,877,935.

Use of a charge transport material containing triarylpyrazoline compound and a binder is disclosed in U.S. Pat. Nos. 4,030,923 and 3,837,851.

It is also disclosed in U.S. Pat. Nos. 3,791,826, 3,899,329, 3,928,034 and 3,898,084 that an organic charge transport material containing 2,4,7-trinitrofluorenone is effective.

Furthermore, it is disclosed in U.S. Pat. Nos. 3,871,882, 3,977,870, 3,904,407 and W. Wiedermann (Papers of Second International Conference on Electrophotography, 224–228) that oxadiazole compounds are effective as the charge transport material. Structures of electrophotographic plates of single layer type containing the charge generating material dispersed in a binder containing these compounds as well as multilayer type comprised of the charge transport layer and the charge generating layer as separate layers, and their functions and effects are also disclosed in detail in these prior art references.

All of these various compounds have a good charge transport characteristic, but have a poor reusability and cannot be used repeatedly without fatigue or without decreasing light sensitivity and dark charge retentivity. This fact has been a bar to the practical application of the compounds.

An object of the present invention is to provide a complex type electrophotographic plate with a charge transport material which is superposed on a layer of a charge generating material formed on an electroconductive substrate. The electrophotographic plate has a light sensitivity equal or superior to that of the conventional materials and better reusability or durability to repetitions without fatigue as well as having a uniform coating while overcoming the disadvantages of the electrophotographic plate containing said prior art materials.

According to the present invention, a complex type electrophotographic plate comprising an electroconductive substrate and a layer comprised of a charge generating material of organic monoazo pigments, bisazopigments, phthalocyanine pigments or chalcogenides of arsenic, cadmium and antimony and a layer of a charge transport material is characterized in that the charge transport material is at least one of compounds represented by the following formula:

$$X-(CH=CH)_n-Ar$$

wherein X represents a heterocyclic group selected from the group consisting of

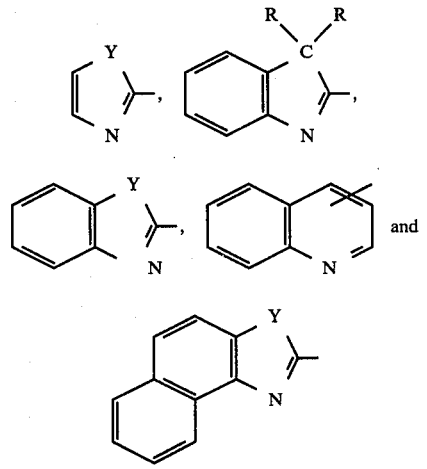

wherein Y represents O, or S; R represents a lower alkyl group; the hetero ring can be substituted, n represents an integer of 0, 1 or 2, and Ar represents an aryl group or a substituted aryl group.

As described above, the charge transport material must meet the following requirements; an effective injection of light carrier (charged particle) generated in the charge generating material by light irradiation is possible; an appropriate light absorption range for not disturbing the specific range of wavelength (4,200–8,000 Å) to be absorbed by the charge generating material is possessed; a distinguished charge transport characteristic is possessed, etc. It is very difficult to prepare a material satisfying all these requirements.

As is well known, the charge generating material photosynthesizes pairs of electrons and holes by light irradiation, and these electrons and holes should be injected into the charge transport material as light carriers, and transported. In that case, however, there is a distinct correlation between the effective injection of light carriers and ionization potential of the charge transport material. It has been disclosed as a result of studies that, when electrons are used as the light carriers, the ionization potential should be high, whereas when the hole is used as the light carrier, the ionization potential should be low. On the other hand, as to an improvement of the important characteristics of electrophotographic plate, that is, a durability or reusability in repetitions, any definite guideline has not been established yet.

In order not to disturb the irradiation light to be absorbed by the charge generating material it is important, as described above, that the charge transport material may not absorb or scatter the irradiation light, and the intransparency and light scattering as in the electrophotographic plate using the ordinary organic material cannot be used. Thus, it is necessary to make the charge transport material in a very uniform film. For example, it is desirable to use a polymer compound, which is hardly consistent with a good light sensitivity.

As a result of various studies on the foregoing prior art knowledge, the present inventors have found that a layer containing the compounds represented by said general formula (which will be hereinafter referred to as "the present compound") have distinguished characteristics as the charge transport material when superposed on a layer of a charge generating material, which may be photosensitized by any suitable sensitizers.

Furthermore, the present inventors have found that the present compound having a melting point of not more than 180° C. has a very good compatibility with a polymer compound, and can form a very uniform film having a good light sensitivity and durability to repetitions without fatigue, as well as a good surface smoothness.

In the present compound, the aryl group of the general formula includes a phenyl group, a naphthyl group, an anthranyl group, etc. The aryl groups and the heterocyclic groups of the general formula can be further substituted with various substituents. The substituent includes, for example, $-CH_3$, $-C_2H_5$, $-C_3H_7$, $-Cl$, $-Br$, $-N(CH_3)_2$, $-N(C_2H_5)_2$, $-N(C_3H_7)_2$, $-OCH_3$, $-C_6H_5$, etc., and particularly $-N(C_2H_5)_2$, $-N(C_3H_7)_2$ and $-C_6H_5$ are preferable, but the substituents are not limited thereto.

Examples of the present compounds will be given below in the structural formula:

(1)

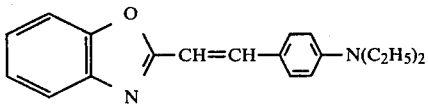

(2)

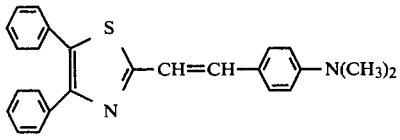

(3)

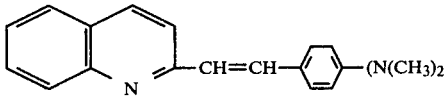

(4)

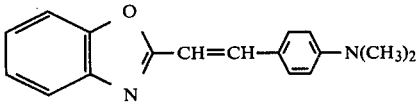

-continued (5)

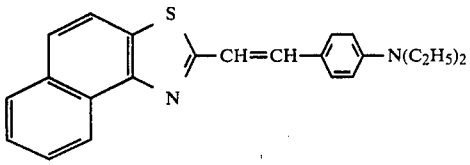

(6)

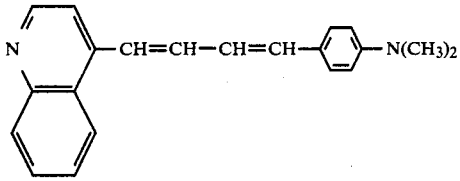

(7)

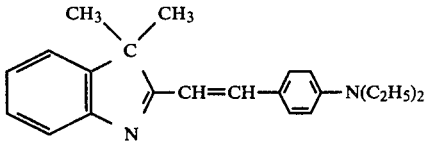

(8)

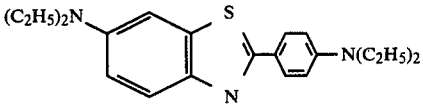

(9)

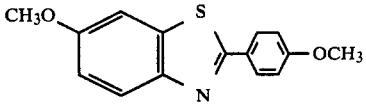

(10)

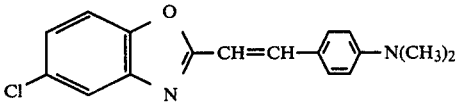

(11)

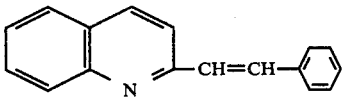

(12)

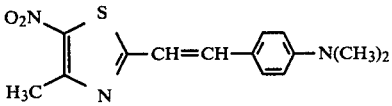

(13)

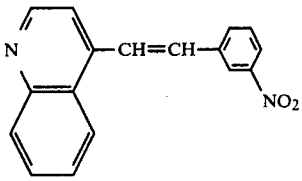

(14)

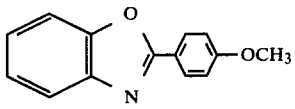

(15)

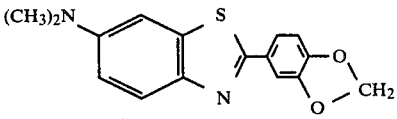

-continued (17)

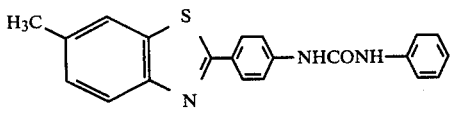

(18)

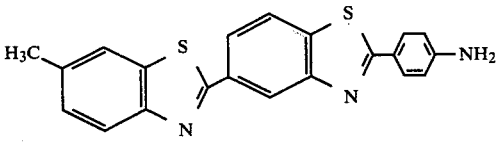

(19)

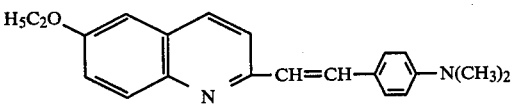

(21)

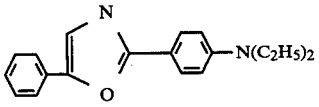

(22)

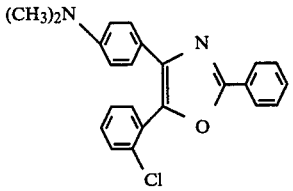

(23)

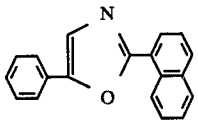

(25)

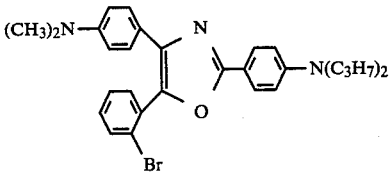

(26)

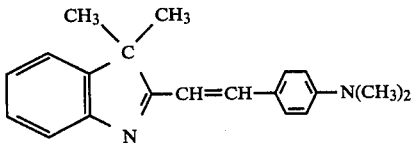

(27)

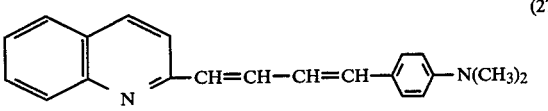

(28)

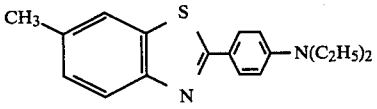

(29)

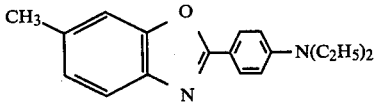

-continued (30)

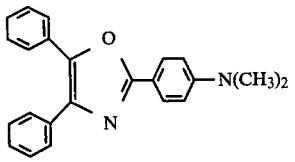

(31)

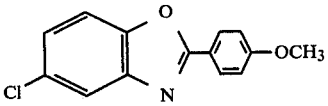

(32)

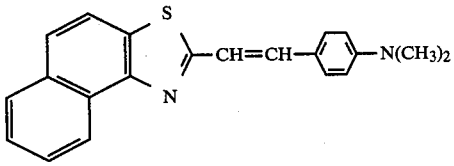

(33)

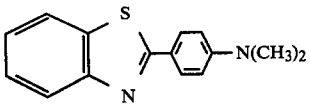

(34)

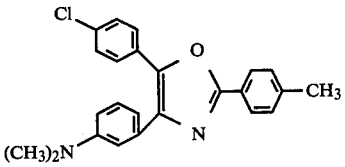

(35)

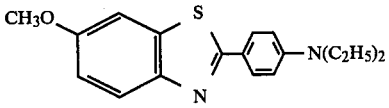

(36)

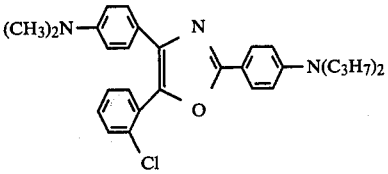

(37)

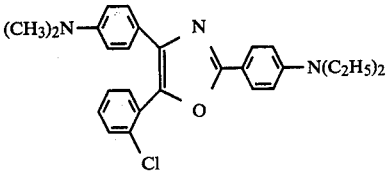

Said compounds are commercially available from Japanese Research Institute for Photosensitizing Dyes, Ltd., Japan as NK dyes, and such as U.S. Pat. Nos. 3,257,203; 3,257,204; 3,279,918; British Patent Specification No. 1,324,543; British Patent Specification No. 895001; Organic Chemicals List, published in 1969 by Japanese Research Institute for Photosensitizing Dye, Japan; and Organic Chemicals List (Supplement), published in 1974 by Japanese Research Institute for Photosensitizing Dye. All compounds disclosed in the specification have been marketted by Japanese Research Institute for Photosensitizing Dyes. Furthermore, some of them are commercially available from Tokyo Kasei Kogyo K.K. as organic reagents.

Compound No. 8 corresponds to Formula 28 of U.S. Pat. No. 3,257,204; compound No. 9 to Formula 19 of U.S. Pat. No. 3,257,204; compound No. 14 to Formula 31 of U.S. Pat. No. 3,257,204; compound No. 15 to formula 29 of U.S. Pat. No. 3,254,204; compound No. 17 to Formula 72 of U.S. Pat. No. 3,257,204; compound No. 18 to Formula 70 of U.S. Pat. No. 3,257,204; compound No. 28 to Formula 11 of U.S. Pat. No. 3,257,204; compound No. 29 to Formula 36 of U.S. Pat. No. 3,257,204; compound No. 31 to Formula 37 of U.S. Pat. No. 3,257,204; compound No. 33 to Formula 4 of U.S. Pat. No. 3,257,204.

Furthermore, compound No. 21 corresponds to No. 3 of U.S. Pat. No. 3,257,203; compound No. 22 to No. 10 of U.S. Pat. No. 3,257,203; compound No. 25 to that of process for No. 39 of U.S. Pat. No. 3,257,203, where 2'-bromo-4-dimethylamine-benzoin is used in place of 2'-chloro-4-dimethylamine-benzoin. Compound No. 30 corresponds to No. 8 of U.S. Pat. No. 3,257,203; compound No. 34 to No. 7 of U.S. Pat. No. 3,257,203; compound No. 35 to No. 3 of U.S. Pat. No. 3,257,203; compound No. 36 to No. 39 of U.S. Pat. No. 3,257,203; compound No. 37 to No. 22 of U.S. Pat. No. 3,257,203.

Compound No. 26 are disclosed in British Patent Specification No. 1324543. Compounds Nos. 1–7, 10–13, 19, .27 and 32 are disclosed in the above-mentioned "Organic Chemicals List". Compound No. 23 corresponds to No. 4 of U.S. Pat. No. 3,279,918.

The reasons why the present compounds are distinguished as the charge transport material are not clear, but it seems due to a synergistic effects of such individual effects that the present compounds are hardly crystallizable, their compatibility with other polymer compounds is high and a strong and uniform film can be readily obtainable, the present compounds have a relatively low ionization potential, and an injection of light carriers from the charge generating material can be easily made when the hole is used as the light carrier, etc.

The present compounds can be used in a single layer after mixed with the charge generating material, or in a multi-layer as a separate layer from the charge generating layer. A charge transport layer can be made from the present compound alone and a distinguished effect can be obtained thereby, but can be also made effectively from a mixture of the present compound with other polymer compound to increase a strength, flexibility, adhesiveness, etc. of the film.

Kind of such polymer compounds is not particularly restricted, and well known binder materials for the electrophotographic plate, for example, at least one of acrylic resin, butyral resin, polyester resin, polyketone resin, polyurethane resin, polyvinylcarbazole, and polycarbonate resin, etc. can be appropriately utilized. A mixing ratio of the polymer compound to the present compound is preferably 0.5–10:1 by weight.

Thickness of the film of the charge generating material and charge transport material in the present invention depends upon a charge characteristic necessary for the electrophotographic plate, and is appropriately less than 100μ. If the thickness is over 100μ, it has been confirmed that the flexibility and photosensitivity of the film will be lowered. When they are used as a single layer, the thickness is usually 5–100μ, whereas when used as a multi-layer, the thickness of a charge generating layer is usually 0.1–5μ and that of a charge transport layer is 5–100μ. In the case of a single layer, an appropriate amount of the charge generating layer is lower than 10% by weight on the basis of the charge transport material, but the mixing ratio can be appropriately selected, depending upon the kinds of these two materials to be used. Desirable particle size of charge generating materials is up to 5μ in diameter when used either as a single layer or as a multi-layer, in view of the desired compatibility.

The electroconductive substrate for the present complex type electrophotographic plate includes brass, aluminum, gold, copper, palladium, etc. or their alloy and can be in the form of sheet, thin plate or cylinder having an appropriate thickness, hardness or flexibility, or can be coated with a thin plastic layer, or can be a metal-coated paper, a metal-coated plastic sheet, or glass coated with a thin layer of aluminum iodide, copper iodide, chromium oxide, indium oxide or tin oxide. Usually, the substrate is electroconductive by itself, or has an electro-conductive surface, and desirably must have a strength high enough for handling.

The charge generating material for the present invention includes well known organic pigments, organic dyes, and their mixtures.

The present invention will be described in detail, referring to Examples and the accompanying drawings, but the present invention will not be limited thereto.

EXAMPLE 1

Figure 1:
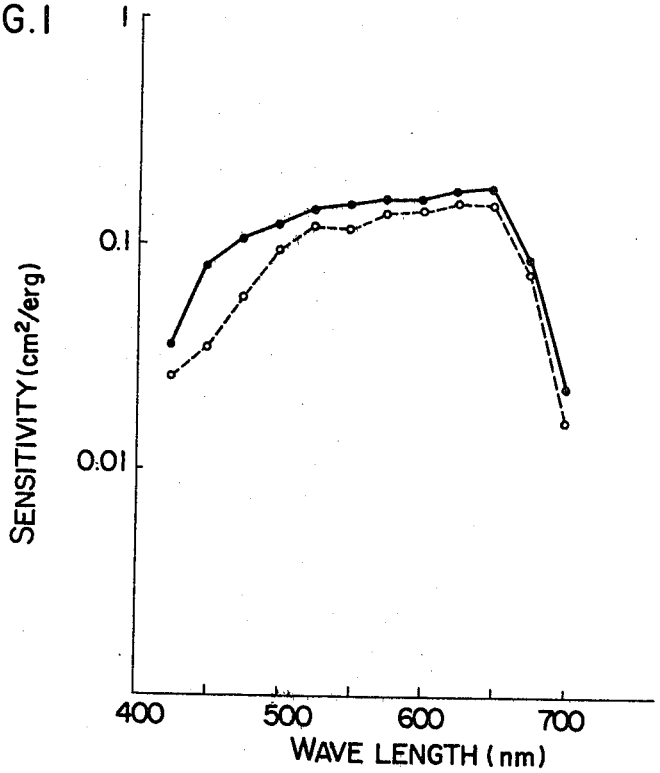
FIG. 1 is a diagram showing relations between a half decay exposure sensitivity and a wavelength of the present electrophotographic plate and the conventional one.

A solution of 1% by weight of chlorodianblue represented by the following structural formula:

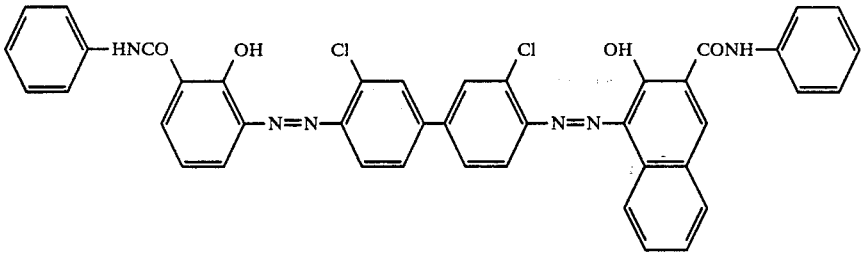

in ethylenediamine was applied to an aluminum-coated polyester film (Metalumy made by Toray Company, Ltd., Japan, film thickness: 50μ) as a substrate, and dried, thereby forming a film of charge generating material having a thickness of about 1μ thereon.

Then, 2-(p-diethylaminostyryl)benzoxazole (NK 1347 made by Japanese Research Institute for Photosenstizing Dyes, Ltd., Japan) represented by the following structural formula:

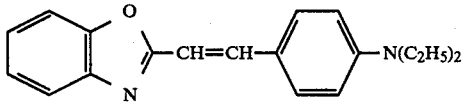

(1)

and polycarbonate resin (Iupilon S2000 made by Mitsubishi Gas-Chemical Company, Inc., Japan) were mixed together at a ratio of 1:2 by weight, and a solution of 16% by weight of the resulting mixture in dichloroethane as a solvent was prepared. The resulting solution was applied to said film of charge generating material by means of an applicator, and dried, thereby forming a charge transport layer having a thickness of about 30μ.

Evaluation was made of electrophotographic characteristics of the thus prepared complex type electrophotographic plate according to an electrostatic paper analyzer (SP-428 made by Kawaguchi Electric Works Co., Ltd., Japan). It was found that a half decay exposure sensitivity of the electrophotographic plate to white light when charged was less than 10 lux-second, which was satisfactorily practicable. Furthermore, evaluation was made of durability when repeatedly used, according to the same analyzer, and it was found that no tendency to lower the electrophotographic characteristics including the half decay exposure sensitivity and dark charge rententivity was observed at all even after more than $10^3$ repetitions.

EXAMPLE 2

A complex type electrophotographic plate was prepared in the same manner as in Example 1, except that a compound represented by the following structural formula (NK-1343, made by Japanese Research Institute for Photosensitizing Dyes, Ltd., Japan) was used as the charge transport material.

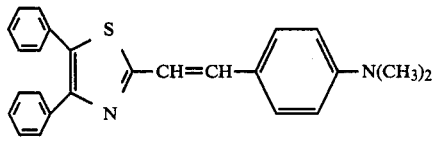

(2)

The resulting electrophotographic plate was subjected to the same test as in Example 1, and a half decay exposure sensitivity of less than 10 lux-second and a durability to more than $10^3$ repetitions were shown.

EXAMPLE 3

A solution of 1% by weight of a squaric acid methine dye represented by the following structural formula in n-butylamine was applied to an aluminum plate as a substrate, and dried, thereby forming a film of charge generating material having a thickness of about 0.5μ.

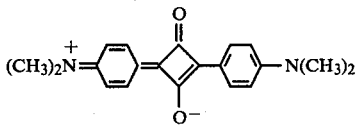

Then, each of 8 kinds of compounds (3)–(10) shown in the following Table 1 as charge transport materials and acrylic resin (Elvasite 2045 made by E. I. duPont de Nemours Co., USA) were mixed at a mixing ratio of 1:1 by weight, and solutions of 8–10% by weight of the respective mixtures in a solvent mixture of dichloromethane and benzene (1:1 by volume) were prepared, and applied to the film of charge generating material, and dried, thereby forming films of charge transport material having a thickness of about 30μ.

The thus prepared complex type electrophotographic plates were subjected to the same test as in Example 1 to investigate their half decay exposure sensitivity and its durability to repetitions. The results are given in Table 1.

As is evident from Table 1, a half decay exposure sensitivity was less than 50 lux-second and a durability to more than $10^3$ repetitions was obtained.

TABLE 1

| Charge transport material | | Half decay exposure sensitivity | Durability to repetitions |
|---|---|---|---|
| No. | Structural formula | Lux-second | repetitions |
| 3 | 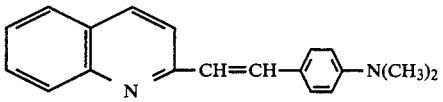 | <10 | >$10^3$ |
| 4 | 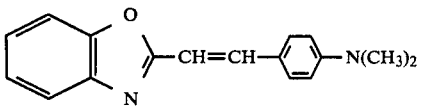 | <10 | >$10^3$ |
| 5 | 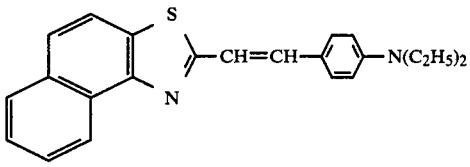 | <10 | >$10^3$ |
| 6 | 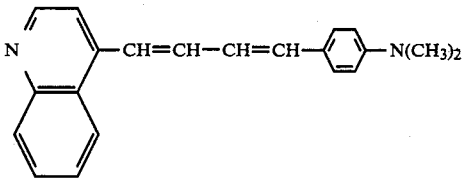 | 20 | >$10^3$ |
| 7 | 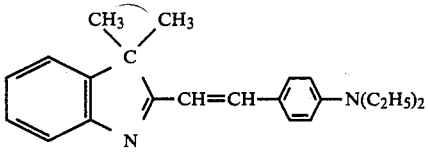 | 10 | >$10^3$ |
| 8 | 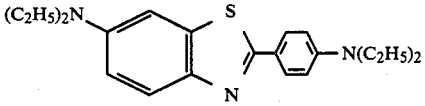 | 30 | >$10^3$ |
| 9 | 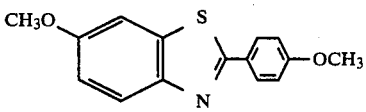 | 50 | >$10^3$ |
| 10 | 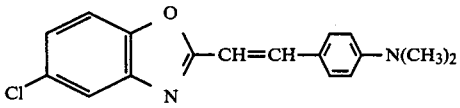 | 50 | >$10^3$ |

EXAMPLE 4

Symuler Fast Blue 4135 (made by Dainippon Ink and Chemicals, Inc., Japan) represented by the following structural formula as a charge generating material was applied to an aluminum plate as a substrate.

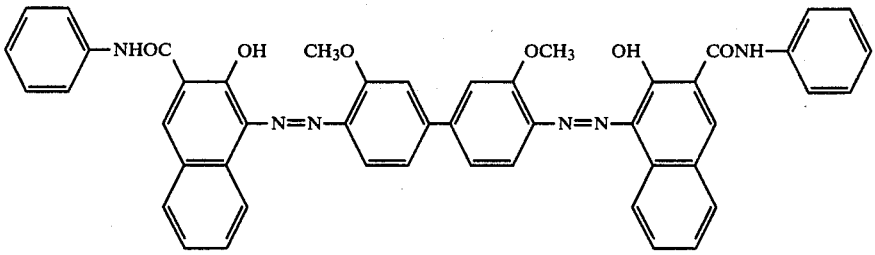

As a charge transport material, 9 kinds of compounds (11)-(19) shown in the following Table 2 were used. The charge generating material and acrylic resin (Elvasite 2045 made by E. I. duPont de Nemours & Co., USA) were mixed at a mixing ratio of 1:1 by weight, and the resulting mixtures were each dissolved in xylene to prepare solutions having a concentration of 10% by weight thereof. Said charge generating material was added to each of the resulting solutions to make a concentration of 10% by weight on the basis of the charge transport material, and 9 kinds of mixed solutions of the charge generating material and the charge transport material were prepared thereby. Each of the resulting solutions was applied to the substrate by means of an applicator, and dried, thereby preparing 9 kinds of complex type electrophotographic plates.

The thus prepared complex type electrophotographic plates were subjected to the same test as in Example 1, to investigate their half decay exposure sensitivity and its durability to repetitions. The results are shown in Table 2.

As in evident from Table 2, a half decay exposure sensitivity was less than 40 lux-second in all the cases, and a durability to more than $10^3$ repeated uses was obtained.

TABLE 2

| Charge transport material | | Half decay exposure sensitivity | Durability to repetitions |
|---|---|---|---|
| No. | Structural formula | Lux-second | repetitions |
| 11 | 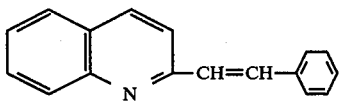 | <10 | $>10^3$ |
| 12 | 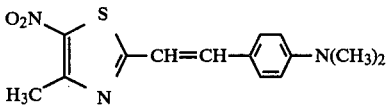 | 20 | $>10^3$ |
| 13 | 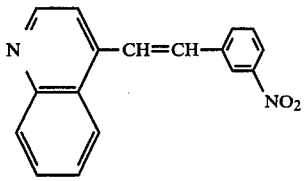 | 30 | $>10^3$ |
| 14 | 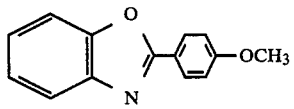 | 20 | $>10^3$ |
| 15 | 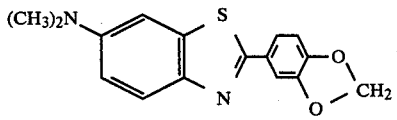 | 40 | $>10^3$ |
| 17 | 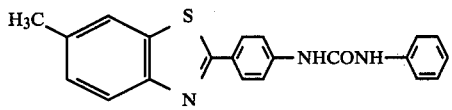 | 40 | $>10^3$ |
| 18 | 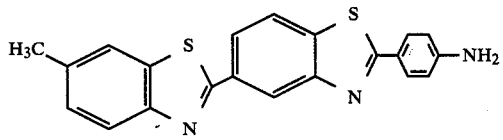 | 40 | $>10^3$ |
| 19 | 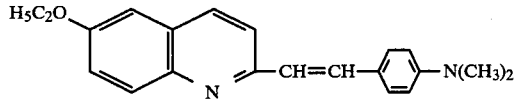 | <10 | $>10^3$ |

EXAMPLE 5

An alloy of Se-Te-As system containing 10% by weight of Te on the basis of $As_2Se_3$ was vapor-deposited on an anodically oxidized aluminum plate as a substrate, thereby forming a film of charge generating material having a thickness of 0.5μ.

Then, 6 kinds of compounds (20)-(25) shown in the following Table 3 were applied each as a charge transport material to the film of the charge generating material in the same manner as in Example 3, thereby forming films of charge transport material having a thickness of about 20μ on the films of the charge generating material.

The thus prepared complex type electrophotographic plates were subjected to the same test as in Example 1 to investigate a half decay exposure sensitivity and its durability to repetitions. The results are shown in Table 3.

TABLE 3

| Charge transport material | | Half decay exposure sensitivity | Durability to repetitions |
|---|---|---|---|
| No. | Structural formula | Lux-second | repetitions |
| 21 | 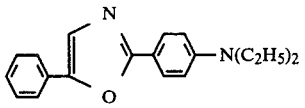 | <10 | $>10^3$ |
| 22 | 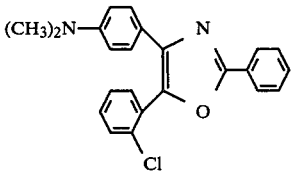 | <10 | $>10^3$ |
| 23 | 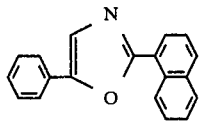 | 20 | $>10^3$ |
| 25 | 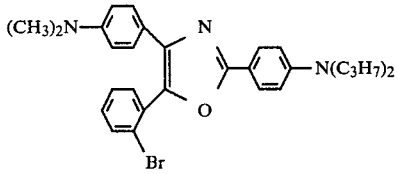 | <10 | $>10^3$ |

As is evident from Table 3, a half decay exposure sensitivity of less than 20 lux-second was obtained in every case, and such very distinguished characteristic as the electrophotographic characteristics being not lowered even after more than $10^3$ repetitions was obtained.

EXAMPLE 6

A solution of 1% by weight of chlorodianeblue represented by the following structural formula in a mixed solvent of ethylenediamine and n-butylamine (1:1 by volume) was applied to an aluminum plate having a thickness of 100μ as a substrate by means of an applicator having a gap of 500μ, and dried, thereby forming a film of charge generating material having a thickness of about 1μ.

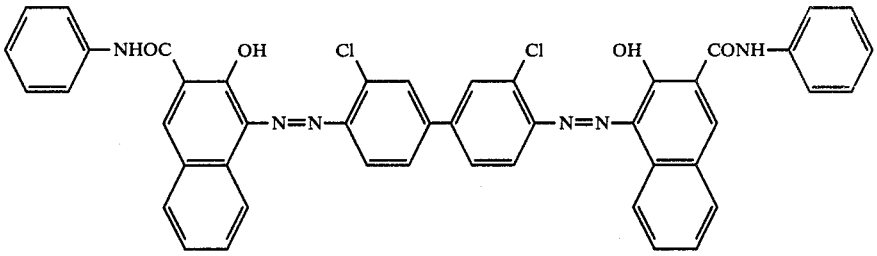

Then, 9 kinds of compounds shown in Table 4 as a charge transport material and a polycarbonate resin (Idemitsu Polycarbonate made by Idemitsu Petrochemical K.K.) were mixed together at a mixing ratio of 1:2, and dissolved in a mixed solvent of dichloromethane and dichloroethane (1:1 by volume) to make solutions having a concentration of 16% by weight thereof. Each of the resulting solutions was applied to the film of the charge generating material by means of an applicator, and dried, thereby forming films of the charge transport material having a thickness of about 25μ.

The thus prepared complex type electrophotographic plates were subjected to the same test as in Example 1 to investigate their half decay exposure sensitivity and its durability to repetitions. The results are shown in Table 4.

TABLE 4

| Charge transport material | | | Half decay exposure sensitivity | Durability to repetitions |
|---|---|---|---|---|
| No. | Structural formula | Melting point (°C.) | Lux-second | repe-titions |
| 1 | 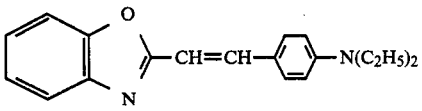 | 128 | <10 | $>10^3$ |
| 2 | 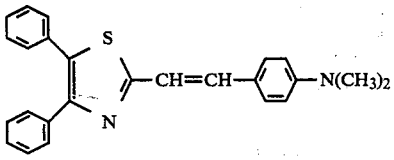 | 165 | <10 | $>10^3$ |
| 5 | 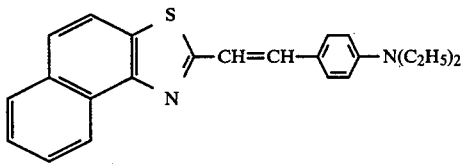 | 113 | <10 | $>10^3$ |
| 26 | 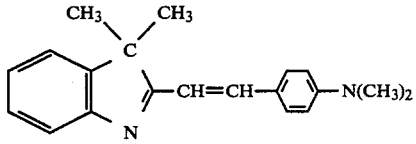 | 111-115 | 50 | $>10^3$ |
| 27 | 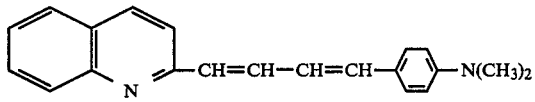 | 136 | 20 | $>10^3$ |
| 28 | 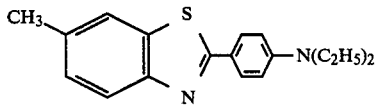 | 128 | 20 | $>10^3$ |
| 29 | 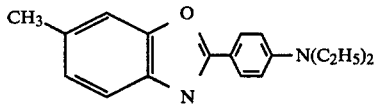 | 108 | 25 | $>10^3$ |
| 30 | 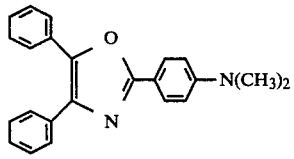 | 134 | 20 | $>10^3$ |
| 31 | 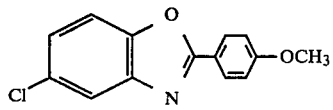 | 148 | 40 | $>10^3$ |

As is evident from Table 4, a good half decay exposure sensitivity of less than 50 lux-second and a good durability to more than $10^3$ repetitions were obtained.

EXAMPLE 7

One part by weight of copper phthalocyanin (Fastogen Blue BB made by Dainippon Ink and Chemicals, Inc., Japan) as a charge generating material and 2 parts by weight of acrylic resin (Elvasite 2045 made by E. I. duPont de Nemours & Co., USA) were dissolved in xylene as a solvent to prepare a solution having a concentration of 4% by weight thereof, and kneaded in a ball mill for 5 hours. One part by weight of each of 6 kinds of compound shown in the following Table 5 as a charge transport material and 2 parts by weight of acrylic acid (same as above) were dissolved in toluene as a solvent to make a solution having a concentration of 15% by weight. 10 Parts by weight of the latter solution was admixed with one part by weight of the former kneaded solution to prepare a coating solution. The coating solution was applied to an aluminum plate as a substrate by means of an applicator to prepare complex type electrophotographic plates.

The thus obtained electrophotographic plates were subjected to the same test as in Example 1. The results are given in Table 5.

Then, 2-(4-dipropylaminophenyl)-4-(4-dimethylaminophenyl)-5-(2-chlorophenyl)-oxazole represented by the general formula:

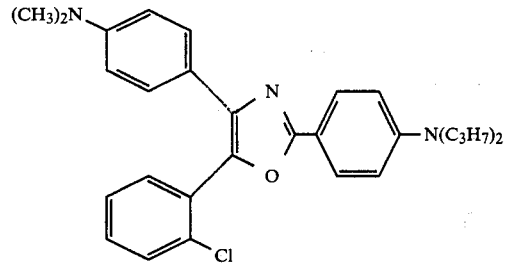

TABLE 5

| Charge transport material | | | Half decay exposure sensitivity | Durability to repetitions |
|---|---|---|---|---|
| No. | Structural formula | Melting point (°C.) | Lux-second | repe-titions |
| 32 | 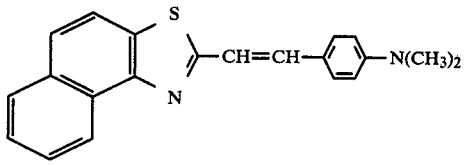 | 170 | <10 | >$10^3$ |
| 33 | 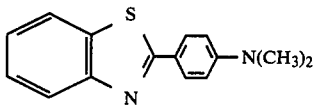 | 173 | 30 | >$10^3$ |
| 34 | 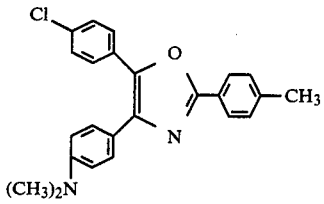 | 95 | 20 | >$10^3$ |
| 21 | 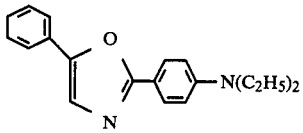 | 79 | 20 | >$10^3$ |
| 35 | 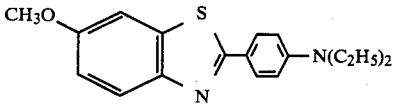 | 140 | 20 | >$10^3$ |
| 6 | 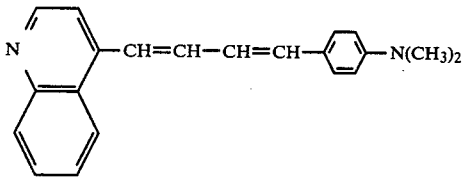 | 163–166 | <10 | >$10^3$ |

EXAMPLE 8

A solution of 1% by weight of chlorodianeblue used in Example 1 in a mixed solvent of ethylenediamine, n-butylanine and tetrahydrofuran (1:1:2 by volume) was applied to an aluminum plate as a substrate by means of an applicator, and dried, thereby forming a film of charge generating material having a thickness of about 3μ.

and polyester resin (Vylon 200 made by Toyobo Company, Ltd., Japan) were mixed together at a mixing ratio of 1:1 by weight, and dissolved in a mixed solvent of dichloromethane and dichloroethane (3:1 by volume) to make a solution having a concentration of 16% by weight, and the resulting solution was applied to the film of the charge generating film, and dried, thereby forming a film having a thickness of about 10μ.

The thus prepared complex type electrophotographic plate had a much distinguished half decay exposure sensitivity of 1.8 lux-second to white light. Then, half decay exposure sensitivities at each wavelength of the plate were investigated, using a light source obtained by a spectrograph of tungsten light source. The results are shown by full line in FIG. 1, where the ordinate shows a reciprocal of the half decay exposure sensitivity (energy in unit erg/cm$^2$), and the abscissa shows the wavelength.

It is seen from FIG. 1 that a distinguished sensitivity is obtained almost in the full range of visible light of 425 to 700 nm.

COMPARATIVE EXAMPLE 1

A complex type electrophotographic plate was prepared in the same manner as in Example 8, except that a pyrazoline derivative having the following general formula was used as the charge transport material:

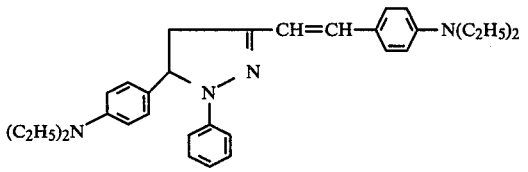

The thus prepared electrophotographic plate was subjected to the same test as in Example 8, and the results are shown by dotted line in FIG. 1.

It is seen from FIG. 1 that the electrophotographic plate using the present compound is better in the range of photosensitive wavelength as well as sensitivity than that using the conventional pyrozoline derivative.

Figure 2:
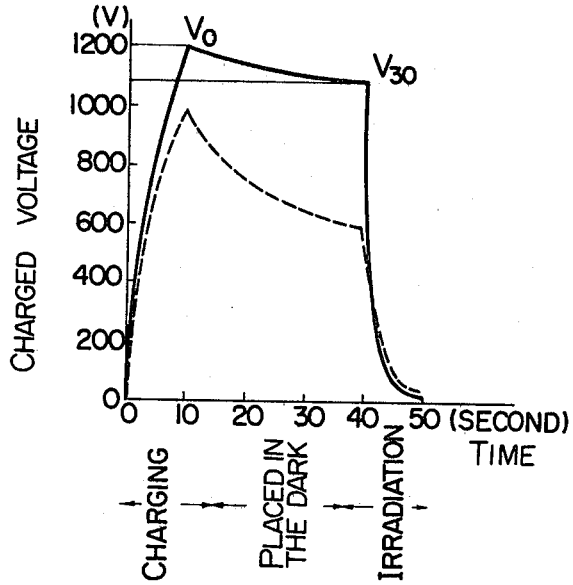
FIG. 2 is a diagram showing changes in charged voltage with time of the present electrophotographic plate and the conventional one.

Changes in charged voltages of complex type electrophotographic plates of Example 8 and comparative Example 1 are shown in FIG. 2 according to the electrostatic paper analyzer SP-428, where the plates were subjected to a step of charging for 10 seconds under a corona voltage of minus 5 KV, a step of leaving the plate in the dark for 30 seconds, and a step of irradiation with white light of 2 luxes for 10 seconds, and a full line shows the complex type electrophotographic plate using the charge transport material of the present invention according to Example 8, and a dotted line shows that using the pyrozoline derivative according to Comparative Example 1.

The electrophotographic plate of the present invention has an initial voltage $V_0$ of more than 1000 V and a dark decay ratio, $V_{30}/V_0$, of 88%, and thus is superior to that using the pyrazoline derivative.

Figure 3:
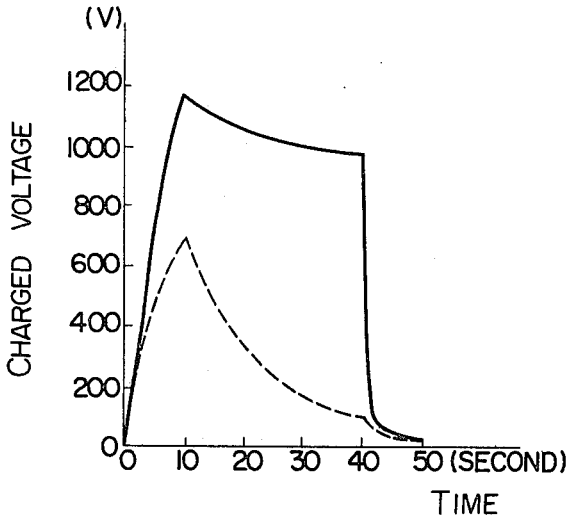
FIG. 3 is a diagram showing changes in changed voltage with time of the present invention and the conventional electrophotographic plate after $10^3$ repeated uses.

In FIG. 3, changes in charged voltages after $10^3$ repetitions of said steps are shown, where the electrophotographic plate of the present invention is substantially not changed in the charged voltage from that shown in FIG. 2, whereas that using the pyrazoline derivative shown by the dotted line undergoes considerable decrease in the charged voltage and considerable increase in the dark decay ratio.

EXAMPLE 9

A perylene pigment having the following general formula was vapor-deposited onto an aluminum plate as a substrate in vacuum of $10^{-6}$ Torr, thereby forming a charge generating layer having a thickness of about 1μ.

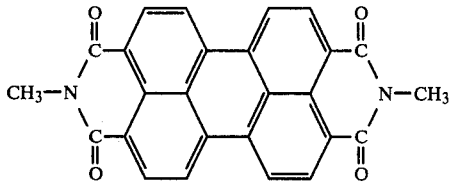

Then, an oxazole derivative represented by the following structural formula, one of the present compounds, and a polyester resin were mixed together at a mixing ratio of 1:1 by weight, and formed into a charge transport layer having a thickness of about 5μ on the charge generating layer.

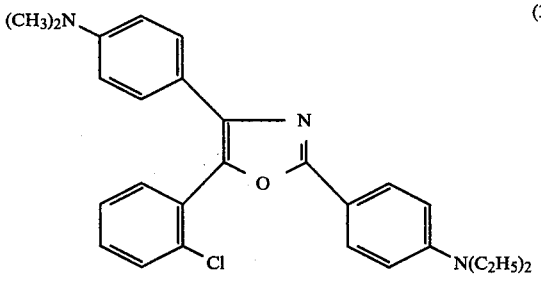

(37)

The thus prepared complex type electrophotographic plate had a very distinguished photosensitivity, that is, a half decay exposure sensitivity of 3.0 lux-second to white light. Results of spectrophotographic sensitivities measured in the same manner as in Example 8 are shown by full line in FIG. 4, where a photosensitive wavelength zone is shifted towards a shorter wavelength side, but the electrophotographic plate can be practically applicable with a satisfaction as a photosensitive plate for the copying machine.

COMPARATIVE EXAMPLE 2

A complex type electrophotographic plate was prepared in the same manner as in Example 9, except that an oxadiazole derivative having the following structural formula was used as a charge transport material.

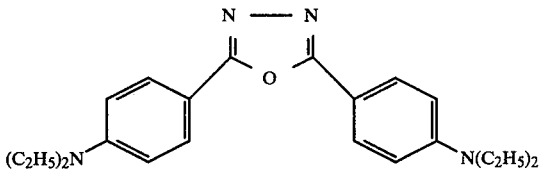

Figure 4:
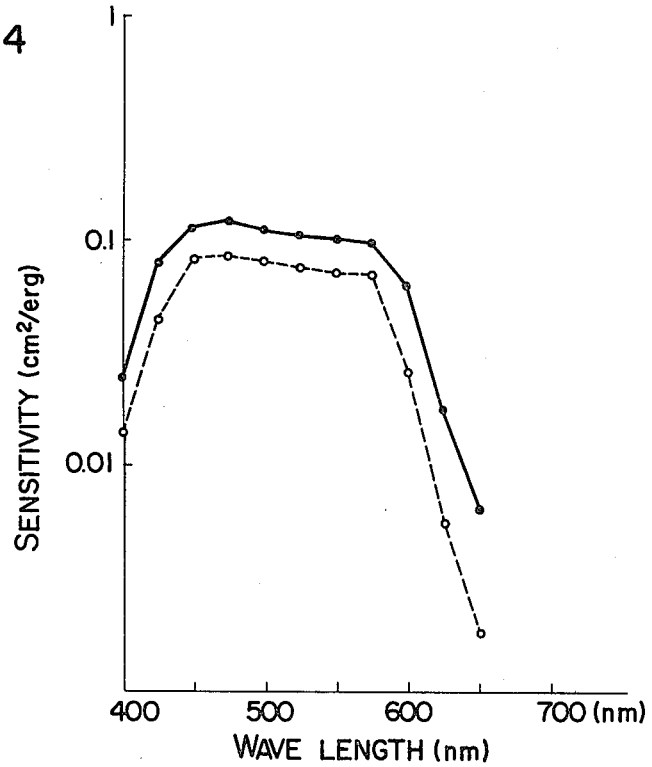
FIG. 4 is a diagram showing relations between a half decay exposure sensitivity and a wavelength of another embodiment of the present invention and the conventional electrophotographic plate.

Spectrophotographic sensitivities of the thus prepared electrophotographic plate, as measured in the same manner as in Example 8, are shown by dotted line in FIG. 4.

It is seen from FIG. 4 that the electrophotographic plate using the present compound according to Example 9 has a higher sensitivity than that according to Comparative Example 2.

As described above, the present complex type electrophotographic plate has a uniform coating surface, a higher half decay exposure sensitivity, its higher durability to repetitions, and a better surface smoothness, and can be effectively applied to many devices well known to those skilled in the art, for example, a copying machine, printer, display element, printing original plate, etc.

Dark decay characteristics of styryl bases using chlorodianblue as charge generating layer were determined at a corona voltage of 5 kV in the same manner as in Example 1 and Comparative Example 1.

As the result, $V_{30}/V_0$ of compound No. 5 was found to be 83, and $E_{50}$ was found to be 8 lux-second. Likewise, $V_{30}/V$ and $E_{50}$ of compound No. 36 were found to be 83 and 5 lux-second, respectively.

The following results were also obtained for compounds Nos. 5, 38–41 and 32.

| | Compound | $V_{30}V_0$ | $E^{50}$(lux-second) |
|---|---|---|---|
| (5) | 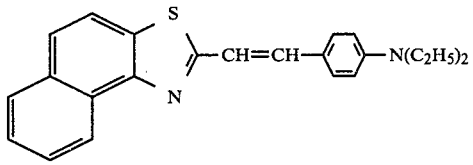 | 83 | 8 |
| (32) | 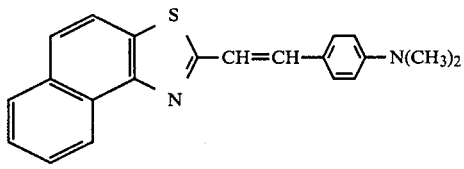 | 82 | 9 |
| (38) | 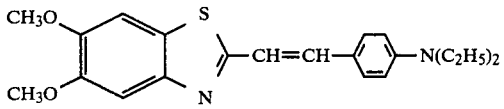 | 83 | 10 |
| (39) | 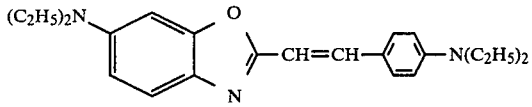 | 86 | 4 |
| (40) | 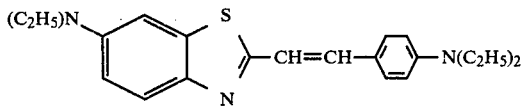 | 77 | 4 |
| (41) | 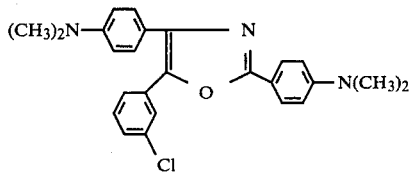 | 77 | 8 |

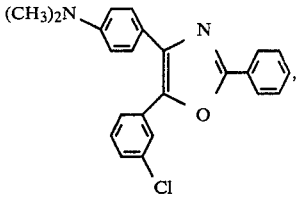

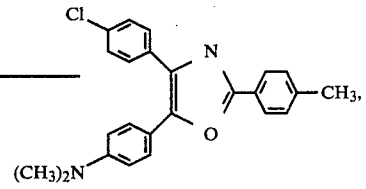

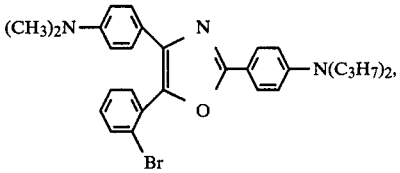

The foregoing compounds are all disclosed in the above-mentioned "Organic Chemicals List".

As described above, the present styryl-based compounds provide an electrophotographic plate with distinguished photosensitivity and dark decay characteristics.

The following compounds have a good light transparency and can give an electrophotographic plate with a good photosensitivity for light in a wavelength range of 45.0 nm or larger:

-continued

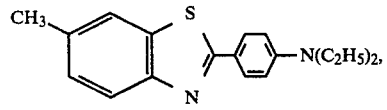

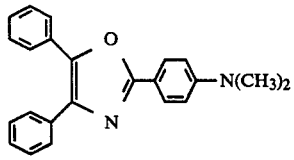

and

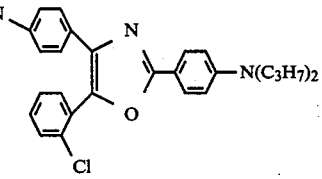

The following compounds have a good compatibility with the resin used as a binder:

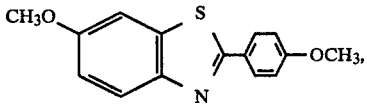

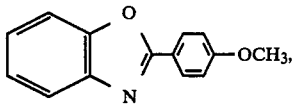

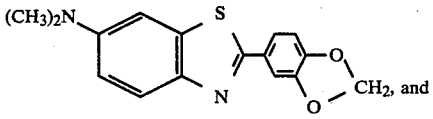

and

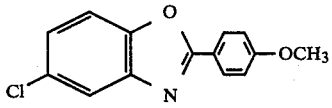

The following compounds have a low ionization potential and are readily ionizable with electrons or holes generated in the charge transfer layer and thus can give an electrophotographic plate with a high photosensitivity:

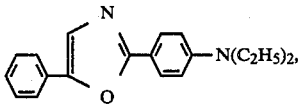

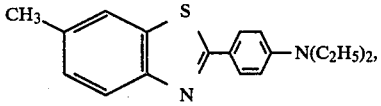

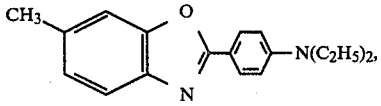

-continued

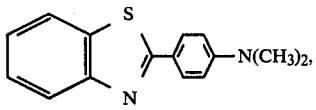

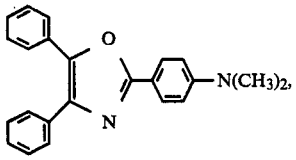

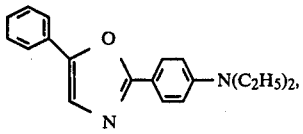

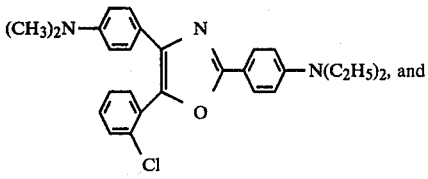

and

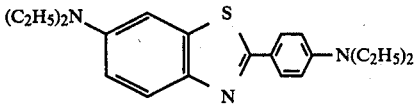

The following compounds can give an electrophotographic plate with a high sensitivity in a wavelength range of 550 nm or larger:

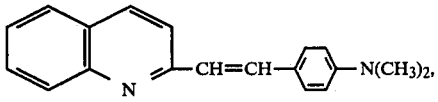

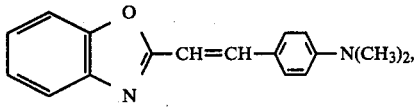

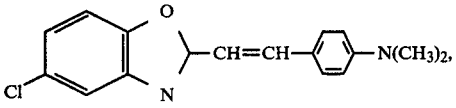

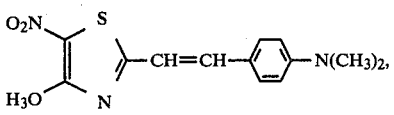

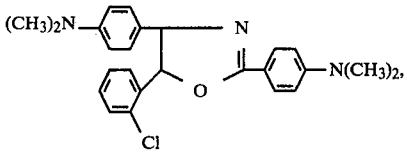

-continued

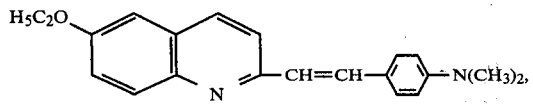

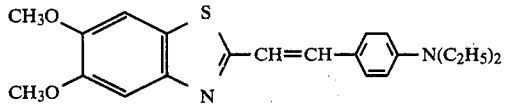

and

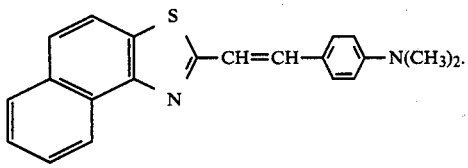

The following compounds show the most distinguished characteristics among the styryl base compounds from the overall viewpoint.

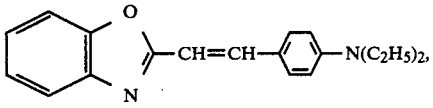

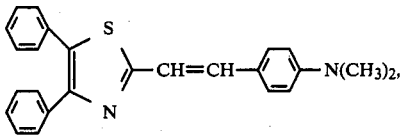

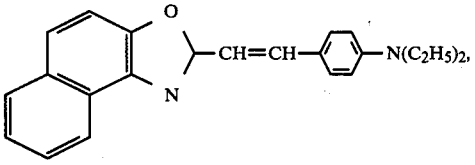

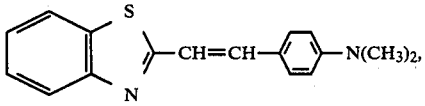

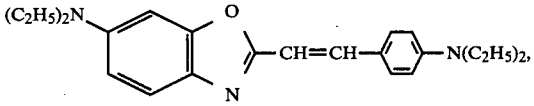

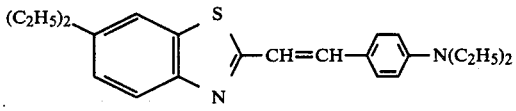

and

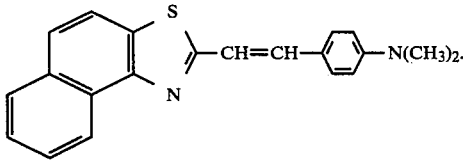

What we claim is:

1. A complex type electrophotographic plate comprising a conductive support; a first layer, adhered to the support, of a charge generating material, said first layer having a thickness of 0.1 to 5 μm; and a second layer, superposed on the first layer, of a homogeneous mixture of a charge transport material, and an insulating, resinous binder therefor, said second layer having a thickness of 5 to 100 μm and being substantially transparent to light of a wavelength of 4200 to 8000 Å; wherein said charge transport material is at least one member selected from the class consisting of nonionic compounds represented by the general formula: X—(CH=CH)$_n$Ar where X is a heterocyclic group selected from the group consisting of

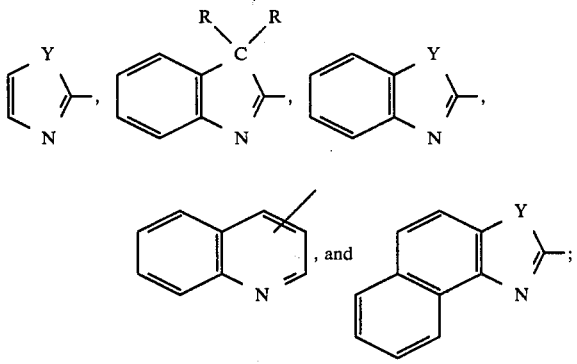

and Y is O or S; R is a lower alkyl group; the hetero ring may be substituted; n is an integer of 0, 1 or 2; and Ar is an aryl or substituted aryl group.

2. A complex type electrophotographic plate according to claim 1, wherein said charge generating material is a member selected from the group consisting of monoazo pigments, bisazopigments and phthalocyanine pigments.

3. A complex type electrophotographic plate according to claim 1, wherein said charge generating material is a member selected from the class of chalcogenides of arsenic, cadmium and antimony.

4. A complex type electrophotographic plate comprising a conductive support; a first layer, adhered to the support, of a charge generating material, said first layer having a thickness of 0.1 to 5 μm; and a second layer, superposed on the first layer, of a homogeneous mixture of a charge transport material and an insulating, resinous binder therefor, said second layer having a thickness of 5 to 100 μm and being substantially transparent to light of a wavelength of 4200 to 8000 Å; wherein said charge transport material is at least one member selected from the class consisting of nonionic styryl compounds represented by the general formula: X—(CH=CH)$_n$Ar where X is a heterocyclic group selected from the group consisting of

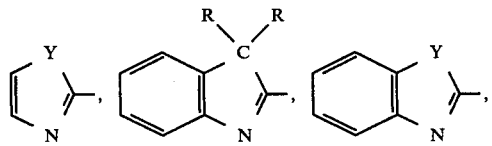

-continued

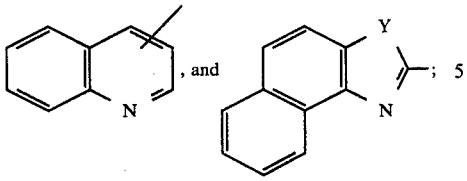

and Y is O or S; R is a lower alkyl group; the hetero ring may be substituted, n is an integer of 1 or 2; and Ar is an aryl or substituted aryl group.

5. A complex type electrophotographic plate according to claim 4, wherein said charge generating material is a member selected from the group consisting of monoazo pigments, bisazopigments and phthalocyanine pigments.

6. A complex type electrophotographic plate according to claim 4, wherein said charge generating material is a member selected from the class of chalcogenides of arsenic, cadmium and antimony.

7. A complex type electrophotographic plate, comprising a conductive support; a first layer, adhered to the support, of a charge generating material, said first layer having a thickness of 0.1 to 5 μm; and a second layer, superposed on the first layer, of a homogeneous mixture of a charge transport material and an insulating, resinous binder therefor, said second layer having a thickness of 5 to 100 μm and being substantially transparent to light of a wavelength of 4200 to 8000 Å; wherein said charge transport material is at least one member selected from the class consisting of nonionic compounds represented by the general formula: X—Ar where X is a heterocylic group selected from the group consisting of

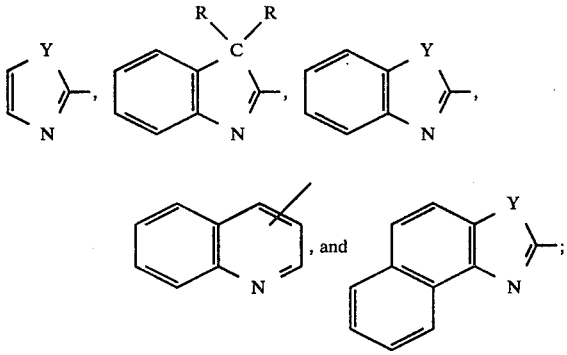

and Y is O or S; R is a lower alkyl group; the hetero ring may be substituted; and Ar is an aryl or substituted aryl group.

8. A complex type electrophotographic plate according to claim 7, wherein said charge generating material is a member selected from the group consisting of monoazo pigments, bisazopigments and phthalocyanine pigments.

9. A complex type electrophotographic plate according to claim 7, wherein said charge generating material is a member selected from the class of chalcogenides of arsenic, cadmium and antimony.

10. A complex type electrophotographic plate according to claim 7, wherein the compounds are members consisting of

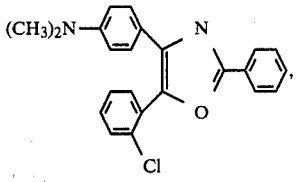

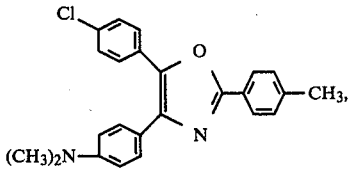

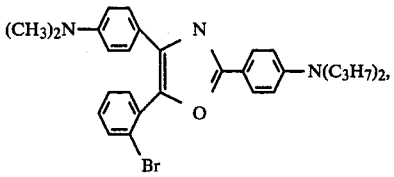

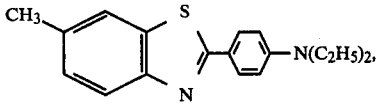

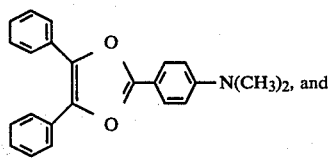

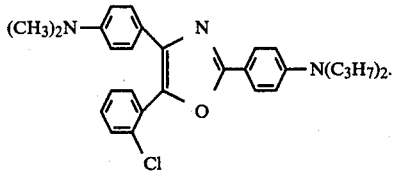

11. A complex type electrophotographic plate according to claim 7, wherein the compounds are members consisting of

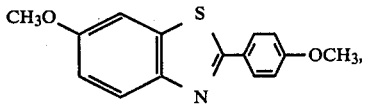

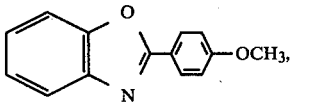

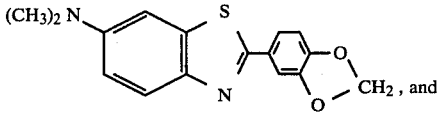

-continued

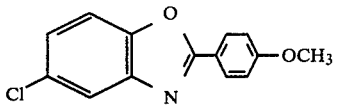

12. A complex type electrophotographic plate according to claim 7, wherein the compounds are members consisting of

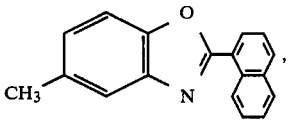

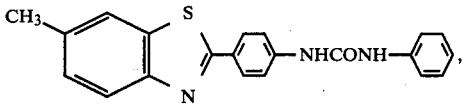

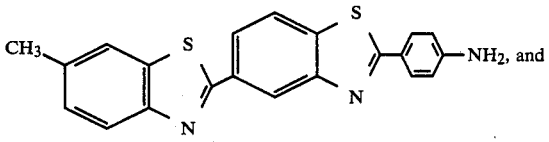

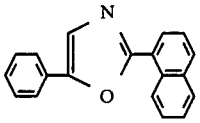

13. A complex type electrophotographic plate according to claim 7, wherein the compounds are members consisting of

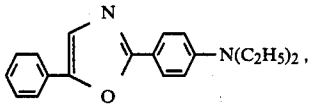

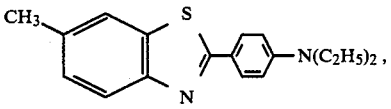

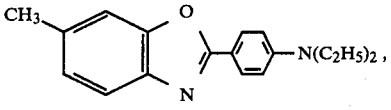

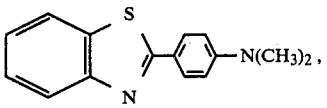

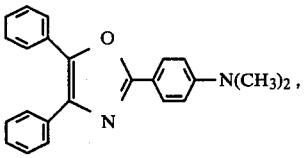

-continued

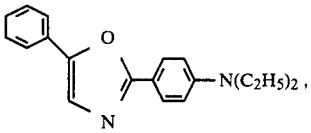

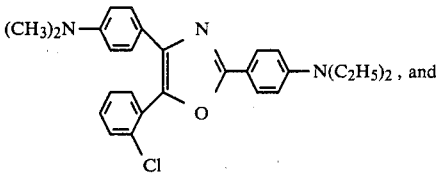

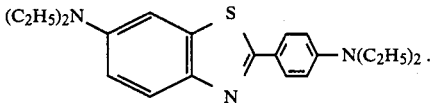

14. A complex type electrophotographic plate comprising a conductive support; a first layer, adhered to the support, of a charge generating material, said first layer having a thickness of 0.1 to 5 μm; and a second layer, superposed on the first layer, of a homogeneous mixture of a charge transport material and an insulating, resinous binder therefor, said second layer having a thickness of 5 to 100 μm and being substantially transparent to light of a wavelength of 4200 to 8000 Å; wherein said charge transport material is at least one member selected from the class consisting of nonionic styryl compounds represented by the general formula: X—(CH=CH)Ar where X is a heterocyclic group selected from the group consisting of

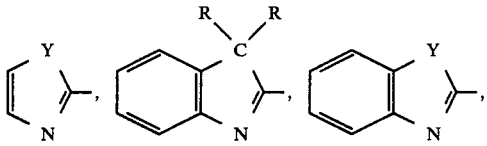

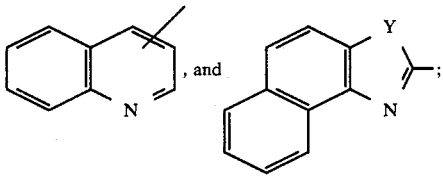

and Y is O or S; R is a lower alkyl group; the heteroring may be substituted; and Ar is an aryl or substituted aryl group.

15. A complex type electrophotographic plate according to claim 14, wherein said charge generating material is a member selected from the group consisting of monoazo pigment, bisazopigments and phthalocyanine pigments.

16. A complex type electrophotographic plate according to claim 14, wherein said charge generating material is a member selected from the class of chalcogenides of arsenic, cadmium and antimony.

17. A complex type electrophotographic plate according to claim 14, wherein the styryl compounds are members consisting of

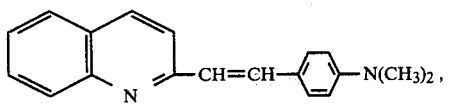
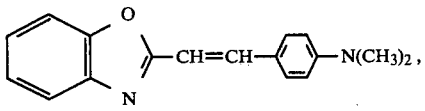
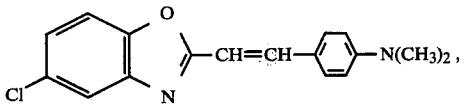
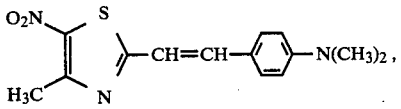
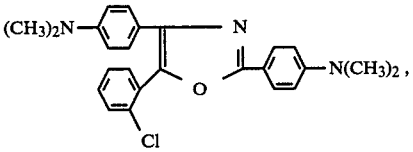
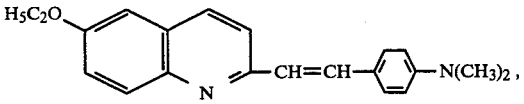
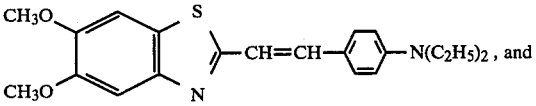
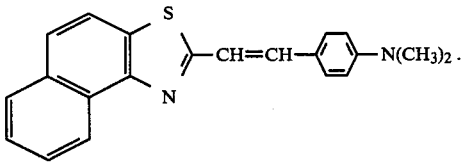
18. A complex type electrophotographic plate according to claim 14, wherein the styryl compounds are members consisting of
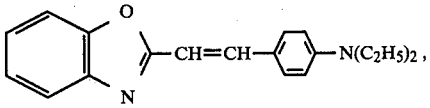
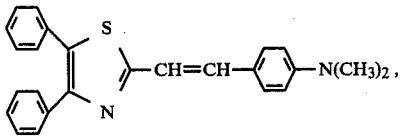
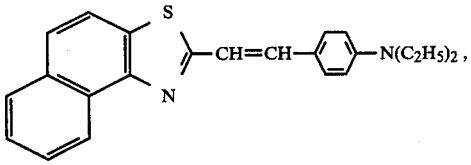
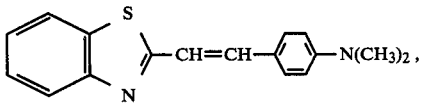
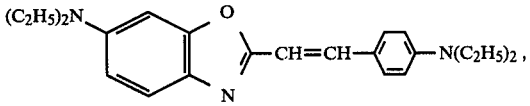
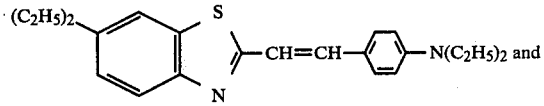
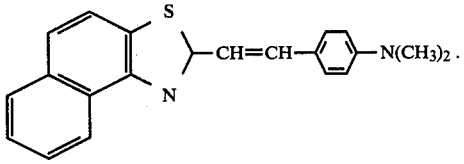
* * * * *